US010960963B2

(12) United States Patent
Aoki et al.

(10) Patent No.: US 10,960,963 B2
(45) Date of Patent: Mar. 30, 2021

(54) UNDERWATER PROPULSION UNIT

(71) Applicant: Yanmar Co., Ltd., Osaka (JP)

(72) Inventors: Hideaki Aoki, Osaka (JP); Takeshi Ouchida, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 0 days.

(21) Appl. No.: 16/494,548

(22) PCT Filed: Mar. 8, 2018

(86) PCT No.: PCT/JP2018/009094
§ 371 (c)(1),
(2) Date: Sep. 16, 2019

(87) PCT Pub. No.: WO2018/168664
PCT Pub. Date: Sep. 20, 2018

(65) Prior Publication Data

US 2020/0010162 A1 Jan. 9, 2020

(30) Foreign Application Priority Data

Mar. 16, 2017 (JP) ..... JP2017-051323

(51) Int. Cl.
*B63H 1/14* (2006.01)
*B63H 1/16* (2006.01)
(Continued)

(52) U.S. Cl.
CPC ..... *B63H 1/14* (2013.01); *B63G 8/08* (2013.01); *B63H 1/16* (2013.01); *B63H 5/07* (2013.01); *B63H 11/02* (2013.01); *B63H 21/17* (2013.01)

(58) Field of Classification Search
CPC ... B63H 1/00; B63H 1/14; B63H 1/16; B63H 11/00; B63H 11/02; B63H 11/08;
(Continued)

(56) References Cited

U.S. PATENT DOCUMENTS 5,253,603 A 10/1993 Mascolo
5,704,817 A 1/1998 Vaughn
(Continued)

FOREIGN PATENT DOCUMENTS

JP 6-159055 A 6/1994
JP 8-239090 A 9/1996
(Continued)

OTHER PUBLICATIONS

International Search Report dated Apr. 10, 2018 issued in corresponding PCT Application PCT/JP2018/009094.

*Primary Examiner* — Lars A Olson
(74) *Attorney, Agent, or Firm* — Norton Rose Fulbright US LLP

(57) ABSTRACT

An underwater propulsion unit including a propeller, a motor, and a housing. The motor is disposed further forward in a propulsion direction than the propeller and drives the propeller into rotation. The housing that accommodates the motor and the propeller includes a first portion and a second portion. In the second portion disposed further rearward in the propulsion direction than the first portion, an introduction inlet and a spout outlet are provided. The introduction inlet introduces water into the housing, and water introduced from the introduction inlet and delivered by the propeller is spouted out of the housing. When viewed in a direction parallel to the propulsion direction, the introduction inlet is disposed further outward than the first portion and introduces water into the housing in a direction parallel to the axis of the propeller.

20 Claims, 4 Drawing Sheets

(51) Int. Cl.

| | |
|---|---|
| ***B63H 21/17*** | (2006.01) |
| ***B63H 5/07*** | (2006.01) |
| ***B63H 11/02*** | (2006.01) |
| ***B63G 8/08*** | (2006.01) |

(58) Field of Classification Search

CPC . B63H 11/10; B63H 5/00; B63H 5/07; B63H 21/00; B63H 21/17; B63B 1/00; B63B 1/34; B63B 35/00; B63B 35/73; B63B 35/79; B63G 8/00; B63G 8/08

USPC ..... 114/312, 315, 337; 440/49

See application file for complete search history.

(56) References Cited

U.S. PATENT DOCUMENTS

| | | | | |
|---|---|---|---|---|
| 6,217,399 | B1 * | 4/2001 | Sinko | B63H 11/08 114/337 |
| 7,207,282 | B1 * | 4/2007 | Ruan | B63C 11/46 114/55.56 |
| 9,174,713 | B2 * | 11/2015 | Item | B63G 8/08 |
| 9,359,044 | B2 | 6/2016 | Langelaan | |
| 2002/0185050 | A1 | 12/2002 | Hilleman | |
| 2016/0185430 | A1 | 6/2016 | Langelaan | |

FOREIGN PATENT DOCUMENTS

| | | | |
|---|---|---|---|
| JP | 2000-211582 | A | 8/2000 |
| JP | 2007-276609 | A | 10/2007 |
| JP | 2008-260467 | A | 10/2008 |

* cited by examiner

UNDERWATER PROPULSION UNIT

CROSS REFERENCES TO RELATED APPLICATIONS

This application is a national stage application pursuant to 35 U.S.C. § 371 of International Application No. PCT/JP2018/009094, filed on Mar. 8, 2018 which claims priority under 35 U.S.C. § 119 to Japanese Patent Application No. 2017-051323 filed on Mar. 16, 2017, the disclosures of which are hereby incorporated by reference in their entireties.

TECHNICAL FIELD

The present invention relates to an underwater propulsion unit that causes propulsion in water by rotating a propeller using a motor.

BACKGROUND ART

This type of underwater propulsion unit is disclosed in, for example, Patent Literature 1 (hereinafter, PTL 1) and Patent Literature 2 (hereinafter, PTL 2). In each of the hydrofoil watercrafts of PTL 1 and PTL 2, an electric motor and a propulsion system are integrated in a pod designed to be embedded in a hydrofoil. The propulsion system includes a propeller and a duct.

CITATION LIST

Patent Literature

PTL 1: Specification of U.S. Pat. No. 9,359,044

PTL 2: Specification of U.S. Patent Application Publication No. 2016/0185430

SUMMARY OF INVENTION

Technical Problem

The underwater propulsion units used in the hydrofoil watercrafts of PTL 1 and PTL 2 each have a structure in which a propeller is disposed inside a cylindrical duct formed with a relatively large diameter. Water is introduced from a large opening (an introduction inlet) formed at the front of the duct and the water is delivered rearward to spout from a spout outlet on the back side. Thus, to achieve downsizing of the rear part of the unit is difficult and entrance of a relatively large foreign matter with water into the duct can be caused.

It is therefore conceivable that, with a structure where an introduction inlet for introducing water is opened through, for example, a side surface of the unit to take in water in a lateral or diagonal direction, a simple shape with less resistance against water can be achieved and entrance of a large foreign matter can be prevented. In this structure, however, particularly during a high-speed navigation, to introduce a sufficient amount of water from the introduction inlet into the unit is difficult. Therefore, the pressure of the water supplied to the propeller can decrease and cavitation can easily occur around the propeller and accordingly, the propulsion efficiency can be reduced. In this point, the structure is susceptible to improvement.

The present invention has been made in view of such circumstances and is aimed at achieving high propulsion efficiency of an underwater propulsion unit particularly during a high-speed navigation by introducing a sufficient amount of water from an introduction inlet.

Solution to Problem and Advantageous Effects of Invention

The problems that the present invention attempts to solve are described above and next, solutions for solving these problems and advantages thereof are described below.

In an aspect of the present invention, an underwater propulsion unit having the following structure is provided. That is, this underwater propulsion unit includes a propeller, a motor, and a housing. The motor is disposed further forward in a propulsion direction than the propeller and drives the propeller into rotation. The housing accommodates the motor and the propeller. The housing includes a first portion and a second portion. The second portion is disposed further rearward in the propulsion direction than the first portion. An introduction inlet and a spout outlet are provided in the second portion. The introduction inlet introduces water into the housing. The spout outlet allows water introduced from the introduction inlet and delivered by the propeller to be spouted outside the housing. When viewed in a direction parallel to the propulsion direction, the introduction inlet is disposed further outward than the first portion. The introduction inlet introduces water into the housing in a direction parallel to an axis of the propeller.

Thus, water present near an external wall of the first portion can be introduced smoothly from the introduction inlet into the housing with the propulsion of the underwater propulsion unit. Further, when the underwater propulsion unit causes propulsion at a higher speed, water in a higher pressure state can be introduced from the introduction inlet. Accordingly, particularly during a high-speed navigation, occurrence of cavitation near the propeller can be prevented. As a result, the propulsion efficiency can be enhanced.

The above-described underwater propulsion unit may preferably be structured as follows. That is, when viewed in a direction parallel to the propulsion direction, the second portion includes a projection that projects further outward than the first portion. The introduction inlet is disposed in a front portion of the projection in the propulsion direction.

Thus, when the underwater propulsion unit causes propulsion, water present further forward than the projection can be introduced smoothly into the housing through the introduction inlet.

It is preferable that, when the underwater propulsion unit is viewed in a direction parallel to the propulsion direction, the projection project in a direction different from a downward direction.

Thus, the introduction inlet is not disposed in a bottom portion of the underwater propulsion unit. Accordingly, even when the underwater propulsion unit runs on a sandy seashore for example, entrance of a large amount of sands from the introduction inlet into the housing can be prevented. As a result, burden of maintenance, such as cleaning and the like, can be reduced.

In the underwater propulsion unit, it is preferable that a filter that restricts entrance of a foreign matter through the introduction inlet be disposed along a surface from which a distance to an axis of the propeller increases rearward in the propulsion direction.

Thus, the filter can prevent an underwater foreign matter from intruding into the housing from the introduction inlet. In addition, since the filter is disposed along the surface thus inclined, the underwater propulsion unit can cause propulsion while smoothly thrusting a foreign matter outward using the filter.

The above-described underwater propulsion unit may preferably be structured as follows. That is, the filter includes a foreign matter restricting member formed to be long and narrow. When viewed in parallel to a direction in which the projection projects further than the first portion when viewed in the propulsion direction, the foreign matter restricting member in a longitudinal direction includes at least one of a portion parallel to the axis of the propeller and a portion inclined at an angle smaller than 45° relative to the axis of the propeller.

Thus, it is enabled to prevent a foreign matter from getting caught and held by the foreign matter restricting member of the filter. Accordingly, increase in resistance during propulsion can be prevented.

DESCRIPTION OF EMBODIMENTS

Figure 1:
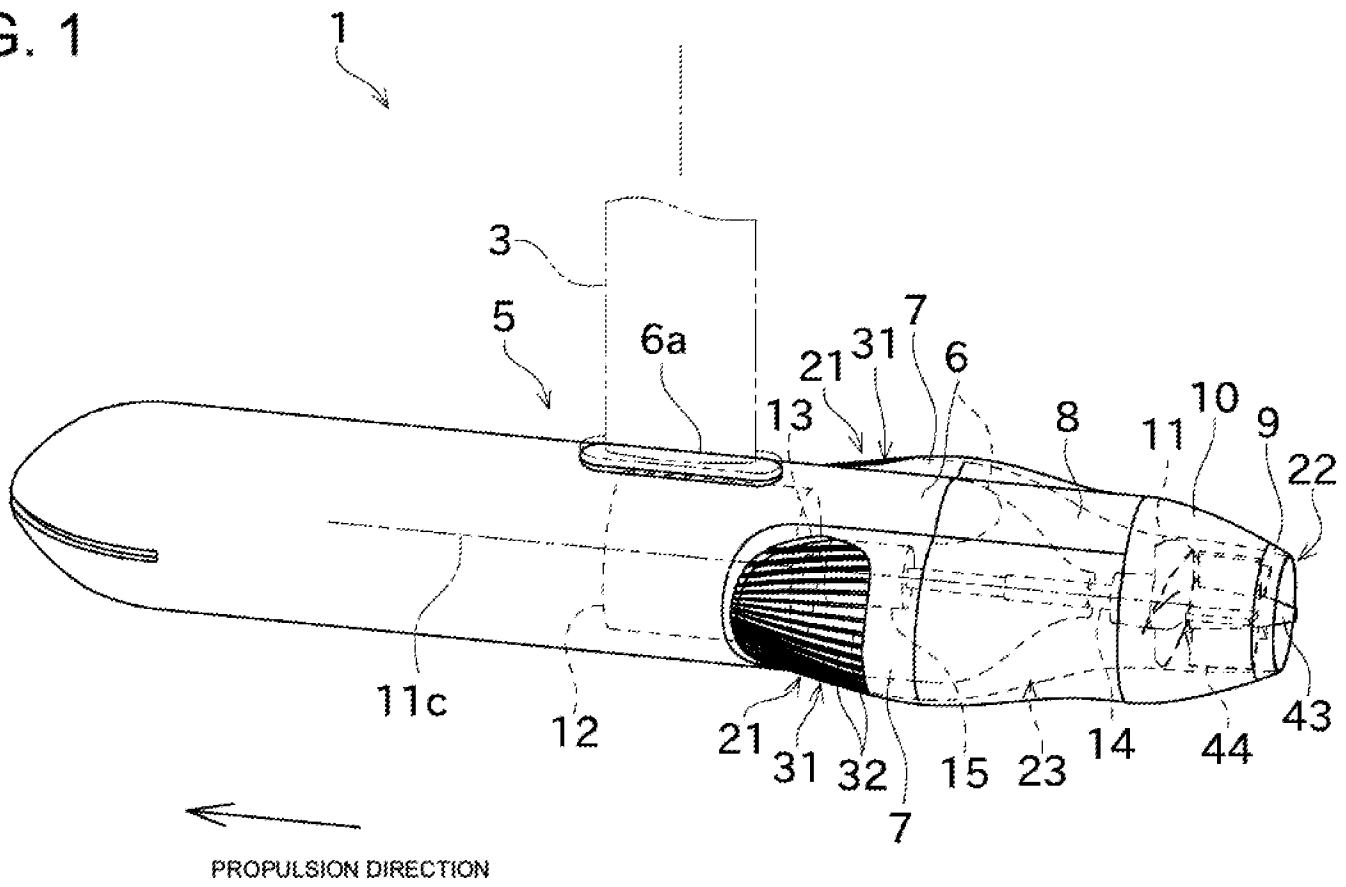
FIG. 1 A perspective view illustrating an overall structure of an underwater propulsion unit according to an embodiment of the present invention.
Figure 2:
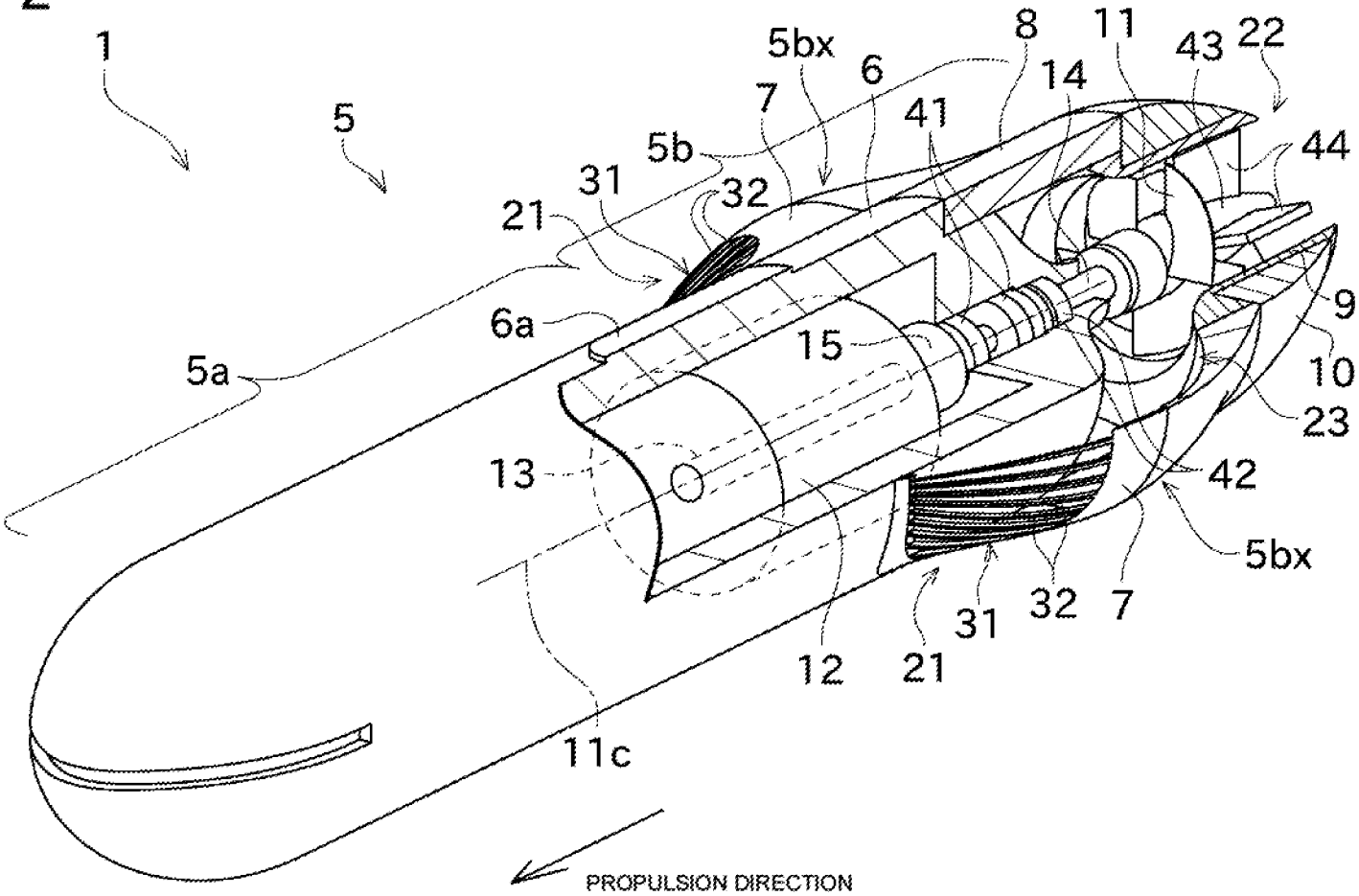
FIG. 2 A perspective view illustrating a partial cross section of the underwater propulsion unit.
Figure 3:
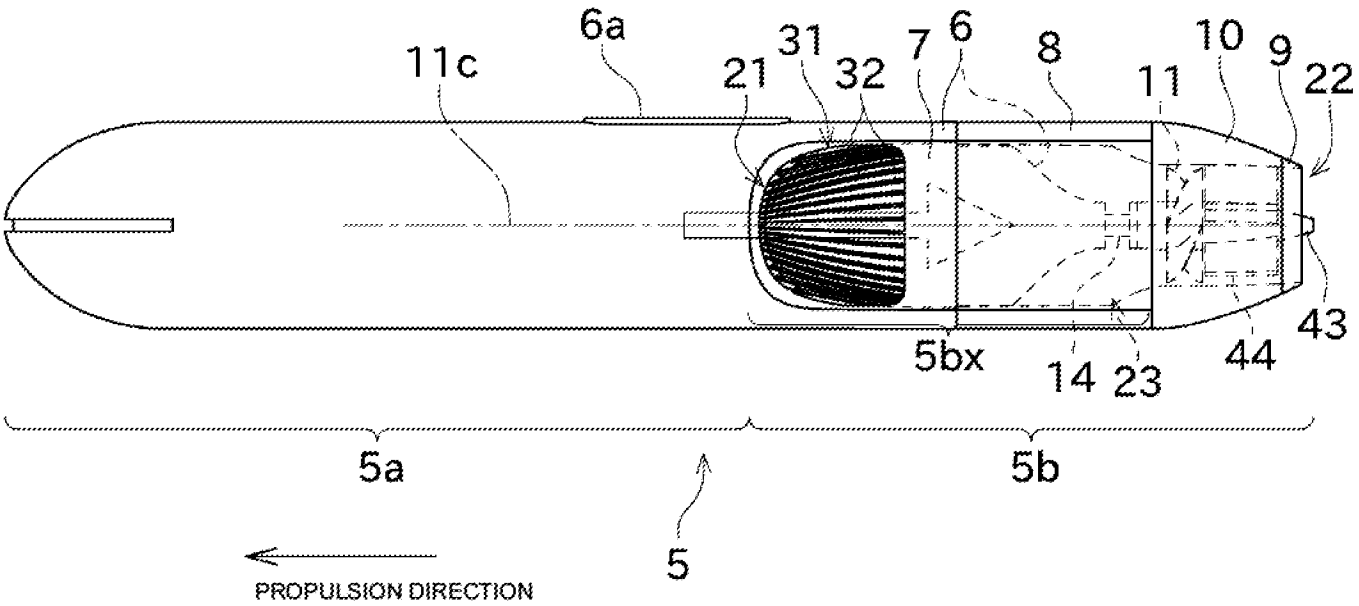
FIG. 3 A side view of the underwater propulsion unit.
Figure 4:
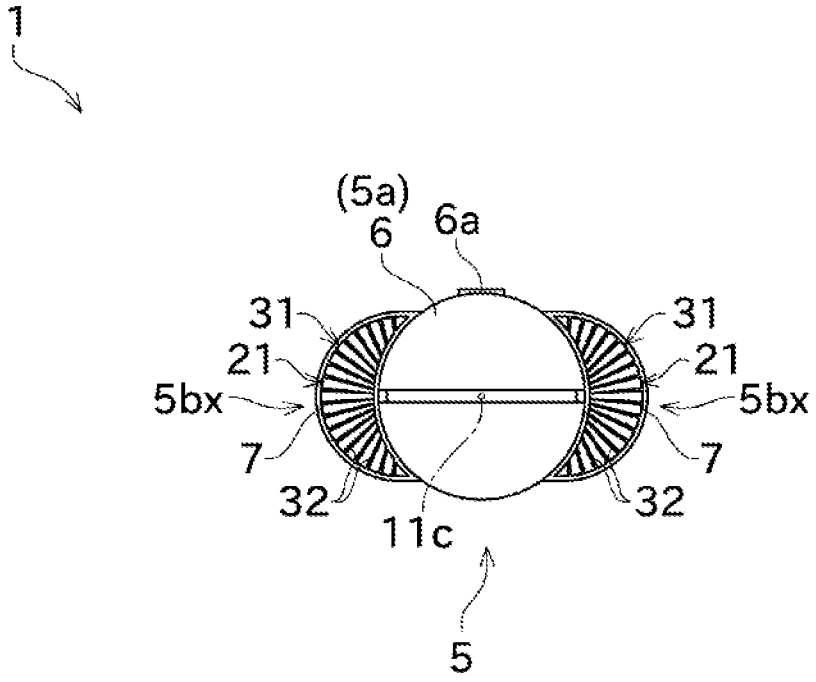
FIG. 4 A front view of the underwater propulsion unit.

Embodiments of the present invention are described below with reference to the drawings. FIG. 1 is a perspective view illustrating an overall structure of an underwater propulsion unit 1 according to an embodiment of the present invention. FIG. 2 is a perspective view illustrating a partial cross section of the underwater propulsion unit 1. FIG. 3 is a side view of the underwater propulsion unit 1. FIG. 4 is a front view of the underwater propulsion unit 1.

The underwater propulsion unit 1 illustrated in FIG. 1 causes propulsion in a certain direction with thrust obtained from electricity. In the present embodiment, the underwater propulsion unit 1 is attached onto a lower portion of an unillustrated sliding body (vehicle), which slides over water with a human aboard, and applies propulsion to the sliding body. The sliding body may be shaped like, for example, a horizontal plate but is not limited to this shape.

The underwater propulsion unit 1 includes a housing 5, a propeller 11, and a motor 12.

The housing 5 forms the exterior of the underwater propulsion unit 1 and accommodates the propeller 11, the motor 12, and the like. The housing 5 includes two introduction inlets 21 for introducing water into the housing 5 and one spout outlet 22 for spouting water outside the housing 5. The introduction inlets 21 and the spout outlet 22 are connected through a channel 23 formed inside the housing 5. The structure of the housing 5 will be described in detail later.

The propeller 11 is rotatably supported inside the housing 5. The propeller 11 is disposed in an intermediate portion of the channel 23 formed inside the housing 5 so that an axis 11*c* of the propeller 11 is oriented in a fore-and-aft direction. The propeller 11 is rotated by driving force of the motor 12 and delivers the water that has entered the channel 23 through the introduction inlets 21 to the spout outlet 22. Accordingly, the water is spouted rearward from the spout outlet 22 and its reaction force moves the underwater propulsion unit 1 forward.

In the description below, the front and rear in a direction in which the underwater propulsion unit 1 moves by spouting water from the spout outlet 22 (a propulsion direction) may simply be expressed with "fore-and-aft," "front," "forward," "rear," "rearward," etc. Further, the left and right in the propulsion direction of the underwater propulsion unit 1 may simply be expressed with "left," "right," "lateral," etc. Up and down directions in a state where the underwater propulsion unit 1 is moving forward may simply be expressed with "up," "upward," "upper," "down," "downward," "lower," etc.

The motor 12 is configured as an alternating current electric motor for example. The motor 12 is disposed inside a waterproof case 6 (waterproof space) of the housing 5. An output shaft 13 of the motor 12 extends rearward and is coupled to a propeller shaft 14 rotatably supported by the waterproof case 6 with interposition of a coupling 15. A rear end portion of the propeller shaft 14 is disposed to come out of the waterproof case 6 and projects into the channel 23. The propeller 11 is fixed to the propeller shaft 14.

The housing 5 is described below in detail. The housing 5 includes the waterproof case 6, filter covers 7, a stream guiding case 8, a propeller supporting case 9, and a rear case 10.

A large portion of the waterproof case 6 is shaped like a cylinder that is long and narrow in the fore-and-aft direction. A rear end portion of the waterproof case 6 (a portion covered by the stream guiding case 8 described later) is approximately shaped like a cone that becomes narrower rearward. A front end portion of the waterproof case 6 is approximately shaped like a hemisphere and accordingly, a front end portion of the housing 5 obtains a streamlined shape.

A fixing part 6*a* is provided on an upper portion of the waterproof case 6. As indicated with a chain line in FIG. 1, a strut 3 having a shape that is long and narrow in the up-and-down direction is fixed to the fixing part 6*a* with an unillustrated fixing member (e.g. a bolt or the like). Thus, the sliding body and the underwater propulsion unit 1 can be coupled to each other.

As illustrated in FIG. 2, the waterproof case 6 is structured to have a hollow shape and a long narrow space is formed inside the waterproof case 6 in the fore-and-aft direction. In this space, the above-described motor 12 is disposed and, for example, an unillustrated inverter for changing the rotation speed of the motor 12 is further disposed. Outside the housing 5, an unillustrated storage battery for supplying power to the motor 12 and the like is disposed. This storage battery may be placed inside the housing 5.

In a rear portion of the waterproof case 6, the propeller shaft 14 is disposed in the fore-and-aft direction and, as illustrated in FIG. 2, is rotatably supported by bearings 41. The axis of the propeller shaft 14 agrees with the axis of the output shaft 13 of the motor 12. Further, a sealing member 42 for preventing intrusion of water into the waterproof case 6 is disposed between the waterproof case 6 and the propeller shaft 14.

The filter covers 7 are fixed as a pair in left and right side rear portions of the waterproof case 6. Thus, a space through which water can pass is formed between each filter cover 7 and the waterproof case 6. Each filter cover 7 has a shape that is inclined so that the amount of its projection in the left and right direction gradually increases rearward. In other words, each filter cover 7 is inclined to have a distance that gradually increases from an axis 11*c* of the propeller 11 rearward. Each of the above-described introduction inlets 21 for introducing water into the inside space is opened through a large portion of the inclined surface.

Thus, the opened surface of each introduction inlet 21 is arranged so that the distance from the axis 11*c* of the propeller 11 increases rearward. Accordingly, as the underwater propulsion unit 1 moves forward, water present further forward than the introduction inlets 21 comes inside the filter covers 7 through the introduction inlets 21 in a direction parallel to the axis 11*c* of the propeller 11 (see the blank arrow in FIG. 3). The pressure of the water introduced from the introduction inlet 21 increases with rise in the speed of the underwater propulsion unit 1. As described above, in the present embodiment, particularly during a high-speed navigation, water in a high pressure state can be smoothly taken into the filter covers 7.

Each filter cover 7 includes a filter 31 disposed along the opened surface of the introduction inlet 21. The filter 31 includes a large number of rod-like members (foreign matter restricting members) 32, which are disposed at spacings. The rod-like members 32 can reject ingress of an underwater foreign matter from the introduction inlet 21 into the housing 5. In addition, since each filter 31 is disposed along the opened surface inclined as described above, the underwater propulsion unit 1 can cause propulsion while smoothly thrusting an underwater foreign matter outward using the filter 31.

When viewed in the direction in which the filter covers 7 project (in the present embodiment, the left and right direction), as illustrated in FIG. 3, the rod-like members 32 are disposed approximately radially. Therefore, the orientations in their longitudinal direction vary little by little among the rod-like members 32. However, the orientation of every rod-like member 32 in the longitudinal direction is substantially along the orientation of the axis 11*c* of the propeller 11. Specifically, when viewed in the above-described direction, the longitudinal direction of each rod-like member 32 is inclined at an angle smaller than 45° relative to the axis 11*c* of the propeller 11. That is, each rod-like member 32 is inclined at an angle smaller than approximately 45° relative to the axis 11*c* of the propeller 11. Accordingly, when the underwater propulsion unit 1 is moving forward, a foreign matter that hits the rod-like members 32 can be allowed to escape smoothly rearward without getting caught by the rod-like members 32. The rod-like member 32 may have a portion that is inclined at an angle larger than or equal to 45° relative to the axis 11*c* of the propeller 11.

The stream guiding case 8 is, for example, attached to cover the rear portion of the waterproof case 6 as illustrated in FIG. 2. A rear end portion of the stream guiding case 8 has a circular shape. Side portions of the stream guiding case 8 on both the left and right sides each have a shape that is inclined so that the amount of its projection in the left and right direction gradually increases forward from the rear end portion. The above-described filter cover 7 is fixed in front of corresponding one of the portions that project as a pair.

The stream guiding case 8 is structured to have a hollow shape and a space through which water can pass is formed inside the stream guiding case 8. The inside of the pair of filter covers 7 and the inside of the stream guiding case 8 are connected to each other. In this structure, water delivered from the pair of filter covers 7 to the stream guiding case 8 positioned further rearward flows diagonally to approach the axis 11*c* of the propeller 11 inside the stream guiding case 8 and merges together.

The propeller supporting case 9 is attached to be connected to a rear portion of the stream guiding case 8. The above-described propeller 11 is disposed inside the propeller supporting case 9.

The propeller supporting case 9 is structured to have a hollow shape and a space through which water can pass is formed inside the propeller supporting case 9. The inside of the stream guiding case 8 and the inside of the propeller supporting case 9 are connected to each other. Accordingly, the water in the stream guiding case 8 can flow to the propeller supporting case 9. The above-described spout outlet 22 is provided at a rear end of the propeller supporting case 9. The space inside the propeller supporting case 9 is opened through the spout outlet 22.

A boss part 43 for supporting a rear end portion of the propeller shaft 14 is disposed in a central portion of the space formed inside the propeller supporting case 9. The boss part 43 is fixed to the propeller supporting case 9 using rectifying blades 44, which are radially disposed. An unillustrated bearing is disposed inside the boss part 43 and the bearing enables an end portion of the propeller shaft 14 to be rotatably supported.

The rear case 10 is formed into a cylindrical shape to cover the outside of the propeller supporting case 9 and attached to be connected to the rear portion of the stream guiding case 8. The outside diameter of the rear case 10 gradually decreases rearward and accordingly, a rear end portion of the housing 5 (around the spout outlet 22) obtains a streamlined shape.

In this structure, the channel 23 inside the housing 5 is formed by mutual connection among the inside of the filter covers 7, the inside of the stream guiding case 8, and the inside of the propeller supporting case 9. While the introduction inlets 21 are disposed at a front end of the channel 23, the spout outlet 22 is disposed at a rear end of the channel 23.

For consideration, the housing 5 according to the present embodiment having the above-described structure can be divided in the fore-and-aft direction into a first portion 5*a* and a second portion 5*b* with a boundary therebetween being a front end portion of each filter cover 7, as illustrated in FIG. 2. The first portion 5*a* is constituted of portions except the rear portion of the waterproof case 6. The second portion 5*b* is a portion where the channel 23 of water is formed inside the housing 5, and is disposed further rearward than the first portion 5*a*. The introduction inlets 21 and the spout outlet 22 are disposed in the second portion 5*b*.

The portions where the filter cover 7 and the stream guiding case 8 project in the left and right direction can be collectively referred to as a projection 5*bx*. The projections 5*bx* are disposed in the second portion 5*b*.

Assuming that the housing 5 is divided in the fore-and-aft direction as described above for consideration, it can be said that, when viewed in a direction parallel to the propulsion direction as in FIG. 4, the projection 5*bx* of the second portion 5*b* is a portion that projects further outward in the left and right direction than the first portion 5*a*. Each introduction inlet 21 is disposed in a front portion of the projection 5*bx* as illustrated in FIGS. 2 and 3.

In other words, as illustrated in FIG. 4, the distance between each introduction inlet 21 and the axis 11*c* of the propeller 11 is longer than the distance between an external wall surface of the first portion 5*a* and the axis 11*c* of the propeller 11. Thus, as described above, water present near the external wall on the both left and right sides of the first portion 5*a* can be taken smoothly from the introduction inlets 21 into the housing 5 with the propulsion of the underwater propulsion unit 1. Accordingly, decrease in the pressure of water in a portion in the channel 23 positioned on the upstream side of the propeller 11 can be suppressed. As a result, occurrence of cavitation near the propeller 11 rotating can be prevented.

When the underwater propulsion unit 1 is viewed in a direction parallel to the propulsion direction (in the present embodiment, from the front) as illustrated in FIG. 4, the projection 5*bx* is provided to project horizontally further in the left and right direction than the first portion 5*a* instead of projecting further downward. In other words, each introduction inlet 21 is provided further outward than the first portion 5*a* while being oriented in a direction except a downward direction. Thus, if the underwater propulsion unit 1 is used at, for example, a sandy beach and runs on the sandy seashore, entrance of sands from the introduction inlet 21 can be hindered because of the structure.

As described above, the underwater propulsion unit 1 according to the present embodiment includes the propeller 11, the motor 12, and the housing 5. The motor 12 is disposed further forward in the propulsion direction than the propeller 11 and drives the propeller 11 into rotation. The housing 5 accommodates the motor 12 and the propeller 11. The housing 5 includes the first portion 5*a* and the second portion 5*b*. The second portion 5*b* is disposed further rearward in the propulsion direction than the first portion 5*a*. The introduction inlets 21 and the spout outlet 22 are provided in the second portion 5*b*. The introduction inlets 21 introduce water into the housing 5. The spout outlet 22 allows water introduced from the introduction inlet 21 and delivered by the propeller 11 to be spouted outside the housing 5. When viewed in a direction parallel to the propulsion direction, each introduction inlet 21 is disposed further outward than the first portion 5*a* as illustrated in FIG. 4. The introduction inlets 21 introduce water into the housing 5 in a direction parallel to the axis 11*c* of the propeller 11.

Thus, water present near the external wall of the first portion 5*a* can be introduced smoothly from the introduction inlets 21 into the housing 5 with the propulsion of the underwater propulsion unit 1. Further, when the underwater propulsion unit 1 causes propulsion at a higher speed, water in a higher pressure state can be introduced from the introduction inlets 21. Accordingly, particularly during a high-speed navigation, occurrence of cavitation near the propeller 11 can be prevented. As a result, the propulsion efficiency can be enhanced.

When the underwater propulsion unit 1 according to the present embodiment is viewed in a direction parallel to the propulsion direction, the second portion 5*b* includes the projections 5*bx* that each project further outward than the first portion 5*a* as illustrated in FIG. 4. Each introduction inlet 21 is disposed in the front portion of the projection 5*bx* in the propulsion direction.

Thus, when the underwater propulsion unit 1 causes propulsion, water present further forward than the projection 5*bx* can be introduced smoothly into the housing 5 through the introduction inlets 21.

When the underwater propulsion unit 1 according to the present embodiment is viewed in a direction parallel to the propulsion direction, each projection 5*bx* projects in a direction different from a downward direction as illustrated in FIG. 4.

Thus, the introduction inlets 21 are not disposed in a bottom portion of the underwater propulsion unit 1. Accordingly, even when the underwater propulsion unit 1 runs on a sandy seashore for example, entrance of a large amount of sands from the introduction inlets 21 into the housing 5 can be prevented. As a result, burden of maintenance, such as cleaning and the like, can be reduced.

In addition, in the underwater propulsion unit 1 according to the present embodiment, the filters 31 for restricting entrance of a foreign matter into the introduction inlets 21 are each disposed along a surface (an opened surface of the introduction inlet 21) from which the distance to the axis 11*c* of the propeller 11 increases rearward in the propulsion direction.

Thus, the filters 31 can prevent an underwater foreign matter from intruding from the introduction inlets 21 into the housing 5. Moreover, since each filter 31 is disposed along the surface inclined as described above, the underwater propulsion unit 1 can cause propulsion while smoothly thrusting a foreign matter outward using the filters 31.

Further, in the underwater propulsion unit 1 according to the present embodiment, each filter 31 includes the rod-like members 32 formed to be long and narrow. In the present embodiment, when viewed in the propulsion direction, each projection 5*bx* projects further in the left and right direction than the first portion 5*a*. When the underwater propulsion unit 1 is viewed in parallel to the direction (that is, in the left and right direction), as illustrated in FIG. 3, each rod-like member 32 in its longitudinal direction includes a portion inclined at an angle smaller than 45° relative to the axis 11*c* of the propeller 11.

Thus, it is enabled to prevent a foreign matter from getting caught and held by the rod-like members 32 of the filters 31. Accordingly, increase in resistance during propulsion can be prevented.

While a preferred embodiment of the present invention is described above, the above-described structure may be modified, for example, as follows.

The waterproof case 6 (the first portion 5*a* of the housing 5) may be structured to have any shape, such as an elliptic cylindrical shape, a polygonal cylindrical shape, or the like, instead of the cylindrical shape.

When the underwater propulsion unit 1 is viewed in a direction parallel to the propulsion direction, the directions in which the projections 5*bx* project from the first portion 5*a* may be, for example, diagonally upper left and right directions instead of the left and right directions. The number of the projections 5*bx* (in other words, the number of the introduction inlets 21) is not limited to two, which form a pair on the left and right sides. The structure may be changed to have, for example, only one projection that projects upward or downward or to have three projections that project downward, upward to the left, and upward to the right.

The opened surface of each introduction inlet 21 (in other words, the filter surface of each filter 31) may be changed to be perpendicular to the axis 11*c* of the propeller 11 instead of being inclined as in FIG. 1.

At least the filter covers 7 or the stream guiding case 8 may be integrally formed with the waterproof case 6. The filter covers 7 and the stream guiding case 8 may be integrally formed with each other. The stream guiding case 8, the propeller supporting case 9, and the like may be integrally formed with each other.

The filter covers 7 may be omitted in the underwater propulsion unit 1. In this case, only portions of the stream guiding case 8 projecting in the left and right directions constitute the projections 5*bx*. An opening at a front end of a portion of the stream guiding case 8 projecting in the left or right direction forms each introduction inlet 21.

The waterproof case 6 may be members separable at the boundary between the first portion 5*a* and the second portion 5*b*.

When viewed in the direction in which the projections 5*bx* project from the first portion 5*a* (in the left and right direction), each rod-like member 32 may be disposed in parallel to the propeller 11.

A speed reducer for reducing the rotation speed may be provided between the output shaft 13 of the motor 12 and the propeller shaft 14.

The underwater propulsion unit 1 is not limited to the structure attached to a sliding body with interposition of the fixing part 6*a* when used. For example, the underwater propulsion unit 1 can be used as a diver propulsion unit with a handle attached to a front portion or the like of the housing 5 and held by a diver who goes under water to operate the unit.

REFERENCE SIGNS LIST

1 underwater propulsion unit
5 housing
5*a* first portion
5*b* second portion
5*bx* projection
11 propeller
11*c* axis of propeller
12 motor
21 introduction inlet
22 spout outlet
31 filter
32 rod-like member (foreign matter restricting member)

The invention claimed is:

1. An underwater propulsion unit comprising:
a propeller coupled to a motor via a propeller shaft, the propeller shaft rotatably supported by a bearing, the propeller interposed between the bearing and the motor;
the motor that is disposed further forward in a propulsion direction than the propeller and is configured to drive the propeller into rotation; and
a housing configured to accommodate the motor and the propeller, the housing including:
a first portion, and
a second portion that is disposed further rearward in the propulsion direction than the first portion, and
wherein:
an introduction inlet and a spout outlet are provided in the second portion,
the introduction inlet is configured to introduce water into the housing in a direction parallel to an axis of the propeller,
the introduction inlet includes a first introduction inlet and a second introduction inlet,
with respect to the propulsion direction, a radial circumference of the housing is defined by the first introduction inlet to a third portion of the housing to the second introduction inlet and to a fourth portion of the housing,
the spout outlet is configured to allow water introduced from the introduction inlet and delivered by the propeller to be spouted out of the housing, and
when viewed in a direction parallel to the propulsion direction, the introduction inlet is disposed further outward than the first portion.

2. The underwater propulsion unit according to claim 1, wherein:
the second portion includes a projection that projects further outward than the first portion when viewed in a direction parallel to the propulsion direction, and
the introduction inlet is disposed in a front portion of the projection in the propulsion direction.

3. The underwater propulsion unit according to claim 2, wherein the projection projects in a direction different from a downward direction when viewed in a direction parallel to the propulsion direction.

4. The underwater propulsion unit according to claim 2, wherein a filter configured to restrict a foreign matter from entering into the introduction inlet is disposed along a surface from which a distance to the axis of the propeller increases rearward in the propulsion direction.

5. The underwater propulsion unit according to claim 4, wherein:
the filter includes an elongated foreign matter restricting member, and
when viewed in parallel to a direction in which the projection projects further than the first portion in the propulsion direction, the elongated foreign matter restricting member in a longitudinal direction includes at least one of a portion parallel to the axis of the propeller and a portion inclined at an angle smaller than 45° relative to the axis of the propeller.

6. The underwater propulsion unit according to claim 1, wherein at least a portion of the motor is interposed between the introduction inlet and the first portion.

7. The underwater propulsion unit according to claim 1, wherein at least a portion of the motor is configured to be interposed between at least a portion of the first introduction inlet and at least a portion of the second introduction inlet.

8. The underwater propulsion unit according to claim 1, wherein with respect to a path about the radial circumference of the housing, the third portion of the housing is between the first introduction inlet and the second introduction inlet.

9. The underwater propulsion unit according to claim 8, wherein, with respect to a path about the radial circumference of the housing:
the second introduction inlet is between the third portion of the housing and the fourth portion of the housing; and
the fourth portion of the housing is between the second introduction inlet and the first introduction inlet.

10. The underwater propulsion unit according to claim 1, wherein each of the first introduction inlet and the second introduction inlet include a filter configured to face towards the first portion of the housing.

11. The underwater propulsion unit according to claim 1, wherein a first diameter is defined by the housing.

12. The underwater propulsion unit according to claim 11, wherein a second diameter defined by the first introduction inlet and the second introduction inlet is greater than the first diameter.

13. The underwater propulsion unit according to claim 12, wherein the second diameter is defined at least in part by an inlet portion of the first introduction inlet and an inlet portion of the second introduction inlet.

14. The underwater propulsion unit according to claim 13, wherein the inlet portion of the first introduction inlet is positioned on a propeller facing side of the first introduction inlet.

15. The underwater propulsion unit according to claim 14, wherein the inlet portion of the second introduction inlet is positioned on a propeller facing side of the second introduction inlet.

16. The underwater propulsion unit according to claim 12, wherein the first introduction inlet includes a first inlet portion and a second inlet portion, the second inlet portion interposed between the first inlet portion and the propeller.

17. The underwater propulsion unit according to claim 16, wherein the second introduction inlet includes a third inlet portion and a fourth inlet portion, the fourth inlet portion interposed between the third inlet portion and the propeller.

18. The underwater propulsion unit according to claim 17, wherein the second diameter is defined at least in part by the second inlet portion and the fourth inlet portion.

19. The underwater propulsion unit according to claim 17, wherein the second inlet portion is configured to extend farther from the housing than the first inlet portion.

20. The underwater propulsion unit according to claim 17, wherein the fourth inlet portion is configured to extend farther from the housing than the third inlet portion.

* * * * *